US007316092B2

(12) United States Patent
DeLeeuw

(10) Patent No.: US 7,316,092 B2
(45) Date of Patent: Jan. 8, 2008

(54) MUZZLE-LOADING FIREARM AND EASILY REMOVABLE BREECH PLUG FOR USE THEREWITH

(76) Inventor: David C. DeLeeuw, 4105 Oakridge Dr., Midland, MI (US) 48640

( * ) Notice: Subject to any disclaimer, the term of this patent is extended or adjusted under 35 U.S.C. 154(b) by 0 days.

(21) Appl. No.: 11/197,811

(22) Filed: Aug. 5, 2005

(65) Prior Publication Data

US 2007/0028499 A1 Feb. 8, 2007

(51) Int. Cl.
*F41C 7/00* (2006.01)

(52) U.S. Cl. ..... 42/51; 42/8; 42/40

(58) Field of Classification Search ..... 42/51, 42/8, 40

See application file for complete search history.

(56) References Cited

U.S. PATENT DOCUMENTS

| | | | | |
|---|---|---|---|---|
| 3,780,464 | A | 12/1973 | Anderson | |
| 4,222,191 | A | 9/1980 | Lee et al. | |
| 4,227,330 | A | 10/1980 | Chapin | |
| 4,232,468 | A | 11/1980 | Chapin | |
| 4,283,874 | A | 8/1981 | Vaughn | |
| 4,437,249 | A | 3/1984 | Brown et al. | |
| 4,700,499 | A | 10/1987 | Knight | |
| 5,010,677 | A | 4/1991 | Carron | |
| 5,511,334 | A | 4/1996 | Ball et al. | |
| 5,642,583 | A | 7/1997 | Ball et al. | |
| 6,176,030 | B1 | 1/2001 | Ball | |
| 6,397,505 | B1 * | 6/2002 | Stratton et al. | 42/47 |
| 6,718,677 | B2 | 4/2004 | Camp | |
| 2004/0134112 | A1 * | 7/2004 | Lizarralde et al. | 42/51 |

* cited by examiner

*Primary Examiner*—Michael J. Carone
*Assistant Examiner*—Gabriel J Klein
(74) *Attorney, Agent, or Firm*—Brooks Kushman P.C.

(57) ABSTRACT

A muzzle-loading firearm includes a breech plug for mating, non-threaded engagement with a housing located at the breech end of an axial bore of the firearm barrel. The plug includes a cylindrically-shaped body member having opposite first and second ends and an outer surface between the ends and configured so that when the plug is positioned within the housing, the outer surface is spaced close to the inside surface of the housing to facilitate insertion and removal of the plug from the housing. The body member is formed with a primer chamber for receiving and retaining a primer or a percussion cap at the first end, and a passageway for fluidly communicating the primer chamber with a powder charge at the second end. The body member may have a powder chamber for receiving and retaining at least part of a powder charge at the second end when the firearm is loaded. The material and dimensions of the body member may be such that the body member deforms radially outwardly so that the outer surface of the body member and the inside surface of the housing form an essentially gas-tight seal during firing. The powder chamber contains much of the powder residue generated by the firing. In order to insure that the muzzle-loader cannot be readily used as, or converted to, a breech-loading firearm, different muzzle-loader/breech plug design features are presented. With one design feature, the maximum cross-sectional inner dimension of the housing is less than the diameter of the bore of the barrel. With another design feature, alignment of the firing pin and primer chamber (or hammer and percussion cap holder) is along an axis not centered with the axial bore of the barrel. The cross-sectional shape of the housing and breech plug may be non-cylindrical. For example, the cross-sectional shape can be oblong, essentially triangular, etc. Thus, conventional, breech-loading ammunition will not be effectively usable in the muzzle-loading firearm.

6 Claims, 4 Drawing Sheets

MUZZLE-LOADING FIREARM AND EASILY REMOVABLE BREECH PLUG FOR USE THEREWITH

BACKGROUND OF THE INVENTION

1. Field of the Invention

The invention relates to muzzle-loading firearms and, in particular, to muzzle-loading firearms and non-threaded, easily removable breech plugs for use with such firearms.

2. Background Art

Modern breech-loading firearms, such as rifles, include a barrel having an axial bore, a stock to support the barrel, and a receiver at the breech end of the barrel. The receiver is comprised of a housing which includes a chamber for insertion of a cartridge into the breech of the barrel, a means for firmly securing the cartridge in the breech of the barrel in a sealed and locked position, a firing pin to discharge the cartridge primer, a trigger to move the firing pin into engagement with the cartridge primer, and an ejector to remove the cartridge after firing. For effective ballistics and accuracy, a close tolerance is required between the outside diameter of a bullet and the bore (inside diameter) of the barrel. Thus, in order to insert a bullet from the breech, the bore of the barrel must be less than or equal to the internal diameter of the chamber. Furthermore, with the exception of small-bore rim fired cartridges, breech-loaded firearms/ammunitions (commonly referred to as "center fire") employ a firing pin/primer location that is centered along the axis of the chamber and bore of the barrel.

Muzzle-loading rifles and other muzzle-loading firearms are also comprised of a barrel with an axial bore and a supporting stock. However, a muzzle-loading rifle is loaded by inserting a charge of powder, wadding and shot through the muzzle end of the barrel and tamping the charge securely into the breech end of the barrel. The powder is then ignited, e.g., by striking a primer or percussion cap, which sends a flame, normally through a small opening or flame bore, into the breech of the barrel through a breech plug or permanently enclosed breech chamber which separates the primer or percussion cap from the powder charge. Currently, all commercially available muzzle-loading firearms with removable breech plugs employ cylindrically shaped threaded connection between the firearm and at least one component of the breech plug. Furthermore, the diameter of these threaded connections is always greater than the bore of the barrel.

Muzzle-loading rifles have several disadvantages in comparison with breech-loading cartridge rifles. They are more difficult and time consuming to load, and require greater skill to use. Malfunctions are more common due to the relatively more complex firing mechanisms required to ignite the powder. Muzzle-loading rifles are affected by inclement weather, particularly rain and moisture which affects the powder and causes the rifle to misfire. Muzzle-loading rifles must also be cleaned thoroughly to prevent clogging and corrosion by the powder residue.

Despite these disadvantages, many hunters and firearm enthusiasts prefer to use muzzle-loading firearms, at least on some occasions, due to the nostalgia and the sport which the muzzle-loaders afford. In addition, many states allow a longer hunting season and special hunting areas for muzzle-loading firearms, due to the greater challenge provided and, consequently, the much smaller number of animals taken.

U.S. Pat. Nos. 4,227,330 and 4,232,468 to Chapin disclose a conversion plug that can be configured to be removably inserted into a breech-loading firearm to convert the firearm into a muzzle-loading type. The conversion plug includes a primer cap-receiving chamber which communicates with the bore of the rifle through a flash hole.

U.S. Pat. No. 4,222,191 to Lee, et al; U.S. Pat. No. 4,437,249 to Brown, et al; U.S. Pat. No. 5,010,677 to Carron; and U.S. Pat. No. 6,718,677 to Camp all disclose variations of the Chapin-type conversion plug for converting a shotgun or rifle into a muzzle-loader. However, since there is no permanent modification of the firearms themselves in these designs, they would still be useful as, and considered to be, breech-loading firearms. These patents disclose conversion plugs for breech-loading firearms, not breech plugs for muzzle-loading firearms.

Various designs have been proposed for the construction of improved muzzle-loading rifles. For example, U.S. Pat. No. 4,700,499 to Knight discloses a muzzle-loading rifle that uses a "nut cracker" type of action in which the hammer is centered with the axis of the bore of the barrel to fire a conventional percussion cap. U.S. Pat. No. 3,780,464 to Anderson and U.S. Pat. No. 4,283,874 to Vaughan disclose mechanisms for replacing the flash hole structure in muzzle-loading firearms to allow firing with modern metallic cartridge primers. Both inventions use a cap covering to hold the primer in place until firing.

U.S. Pat. Nos. 5,511,334 and 5,642,583, issued to Ball, et al., disclose a two-component breech plug design where one of the components is cylindrically shaped and readily removable. However, the flame bore extending through these components can become clogged or corroded after repeated use. This may require that various components be replaced at some expense.

U.S. Pat. No. 6,176,030 issued to Ball discloses an improved muzzle-loading firearm and three-component breech plug. The improvement is achieved by modifying the design of the two-component breech plug described in the above-referenced Ball patents to include a replaceable aperture adjacent to the firing chamber (third component) which can be easily replaced if damaged beyond repair. The firing module described in this patent permits loading of the firearm as a muzzle-loader, while also permitting the firing module to be inserted and ejected like a cartridge in a conventional breech-loading firearm. This firing module breech plug design greatly simplifies the insertion and removal of a primer from the firearm.

The disclosure of each patent referenced above is hereby incorporated by reference in its entirety.

Unfortunately, each of the above-noted muzzle-loader/breech plug designs requires at least a portion of the breech plug to be attached using threaded connections and various "tools" for their insertion and removal. Such tools are awkward to use and the intricate designs require time-consuming cleaning operations to disassemble, clean powder residue from complex shapes (including threads), and reassemble. In addition, these complex shapes are expensive to manufacture and these designs are not conducive to unloading by means other than firing the charge. Furthermore, in all of the firearms suitable for use by the above-noted patents, when a firing pin or hammer is used along the axis of the barrel, it is centered with the bore of the barrel. Finally, in each of the firearms suitable for use by these patents, the housing that receives the breech plug is cylindrical and threaded with an inside diameter that is greater than the bore of the barrel.

SUMMARY OF THE INVENTION

Objects of some embodiments of the present invention are to provide: a muzzle-loader/breech plug design where the breech plug and housing are non-threaded; the breech plug is easily removable; the muzzle-loader and breech plug are relatively inexpensive to manufacture; the muzzle-loader is easily unloaded without firing; the muzzle-loader is easy to clean after firing, and the muzzle-loader cannot be effectively used as, or readily converted to, a breech-loading firearm.

In carrying out the above objects and other objects of the present invention, a breech plug configured for mating engagement with a housing located at the breech end of the barrel of a muzzle-loading firearm is provided. The plug includes a non-threaded body member having opposite first and second ends and an outer surface between the ends and configured so that the outer surface is spaced close to (small tolerance to facilitate insertion and removal) the inside surface of the housing. The body member is formed with a primer chamber for receiving and retaining a primer or a percussion cap at the first end. A passageway fluidly communicates from the primer to the powder charge. The shape of the plug may be other than cylindrical. For example, the cross-sectional shape may be oblong, essentially triangular, etc.

The plug may include a powder chamber to receive and retain part or all of the powder charge at the second end when the firearm is loaded.

The material and dimensions of the body member may be such that the body member deforms radially outwardly so that the outer surface of the body member and the housing form an essentially gas-tight seal during firing and the powder chamber contains much of the powder residue generated by the firing.

The plug may include a notch adjacent the primer chamber to permit the primer or percussion cap to be removed from the primer chamber.

The primer chamber may be disposed along or off a central axis of the plug.

The plug may include an alignment notch in the outer surface between the ends to ensure that the primer chamber is properly angularly positioned within the barrel about the central axis.

The plug may include a lateral peripheral rim portion at the first end to allow the plug to be ejected from the firearm by an ejector of the firearm. The alignment notch may be formed in the rim portion.

In carrying out the above object and other objects of the present invention, a muzzle-loading firearm is provided with a housing at the breech end of the barrel to accept the unthreaded breech plug designs described above where the maximum cross-sectional dimension of the housing is less than the diameter of the bore of the barrel. Alignment of the firing pin and primer chamber (or hammer and percussion cap holder) may be along the axis of the bore, but not centered with the bore of the barrel.

The shape of the muzzle-loader housing may be non-cylindrical. For example, the cross-sectional shape can be oblong, essentially triangular, etc.

The muzzle-loader may include an alignment tab at the breech end of the housing to engage with a notch in the breech plug and ensure that the primer chamber is properly angularly positioned within the barrel about the central axis.

The muzzle-loader may include an ejector that engages with the lateral peripheral rim portion at the first end of the breech plug to allow the plug to be ejected from the firearm. The alignment tab may be formed in the ejector.

The above objects and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT(S)

Figure 1:
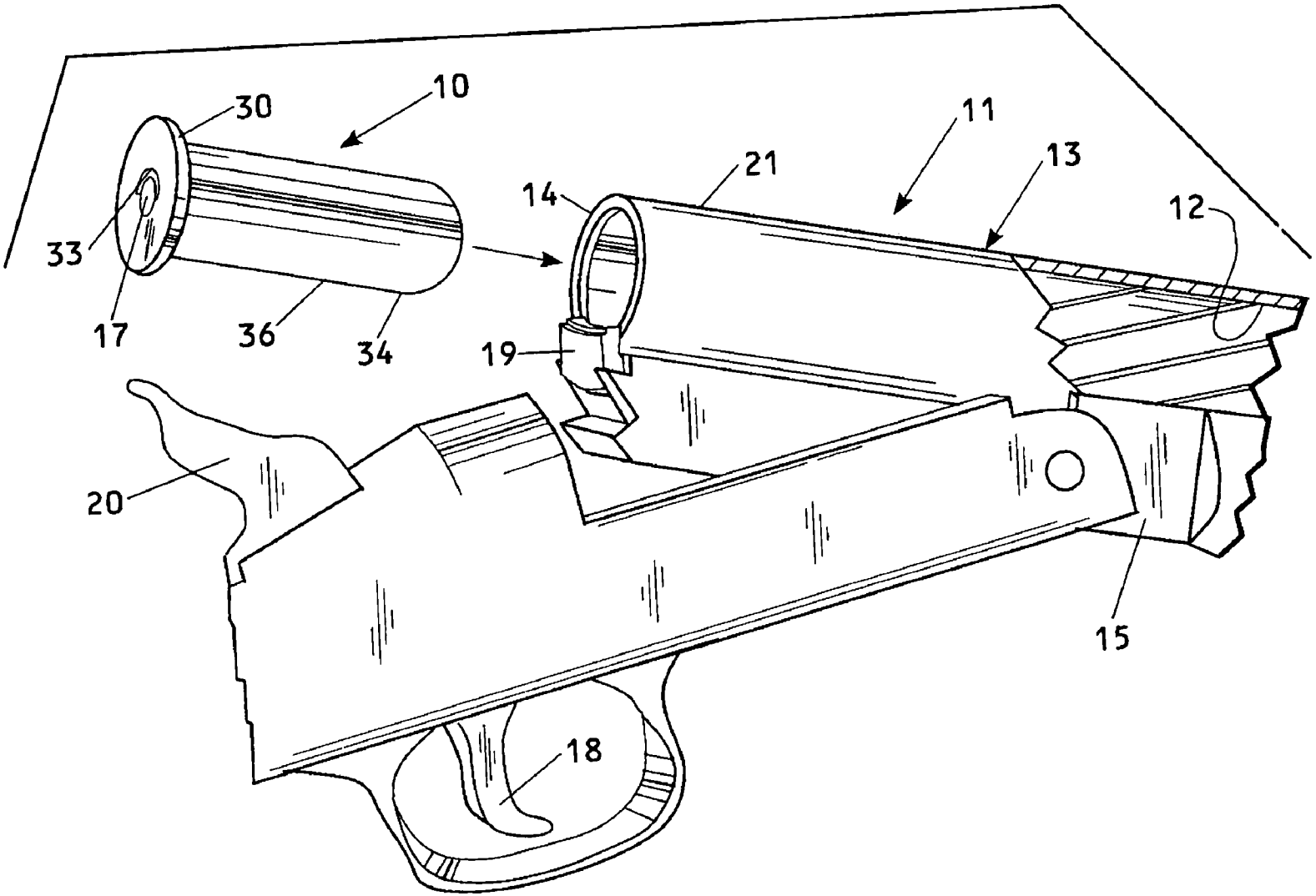
FIG. 1 is an environmental perspective view, partially broken away and in cross section, showing one embodiment of a breech plug of the present invention prior to insertion into a muzzle-loading firearm of the present invention.
Figure 2:
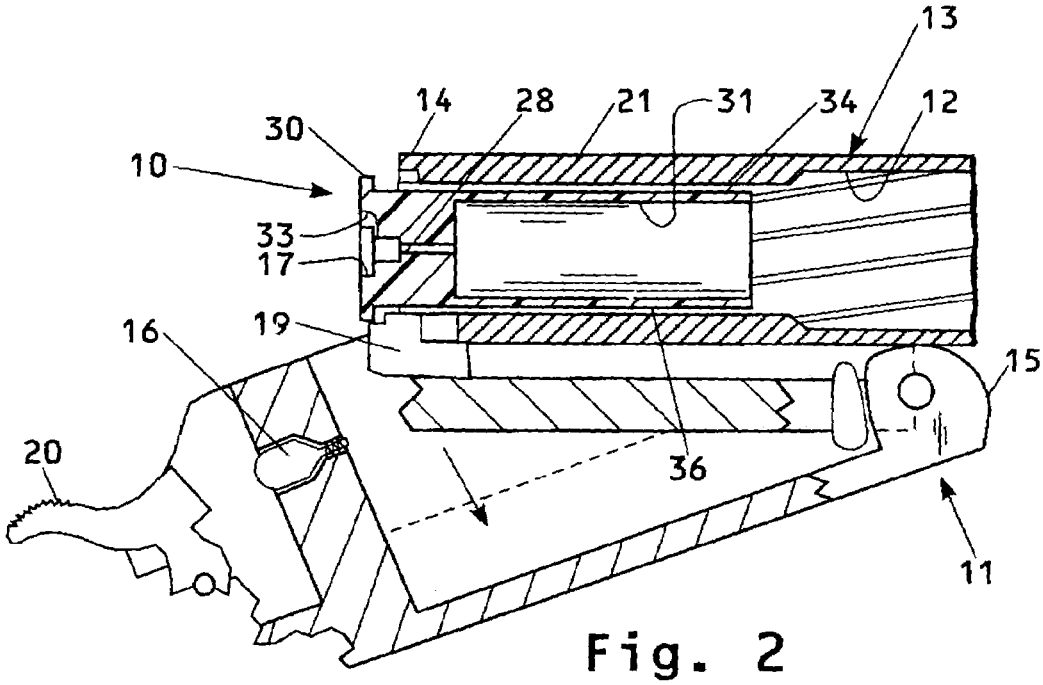
FIG. 2 is a side view, partially broken away and in cross section, of the plug in the process of being ejected from the firearm of FIG. 1.

Referring to FIGS. 1-6, one embodiment of a muzzle-loading firearm or muzzle-loader including a breech plug constructed in accordance with one embodiment of the present invention is schematically indicated. A non-threaded plug 10 is to be inserted slidably into a housing 21 at the breech end 14 of the muzzle-loading firearm, generally indicated at 11 in FIG. 1.

In the preferred embodiment, the muzzle-loader 11 includes a barrel 13 with the breech end 14 at which is located the cylindrical housing 21. An axial bore 12 of the barrel 13 accepts the non-threaded breech plug 10 wherein the inside diameter of the housing 21 is less than the inside diameter of the bore 12 of the barrel 13. Also, as shown in FIGS. 3 and 4, alignment of a firing pin 16 and a primer holder or chamber 17 (or a hammer 20 and percussion cap holder 17) is along the axis of the bore 12.

Figure 3:
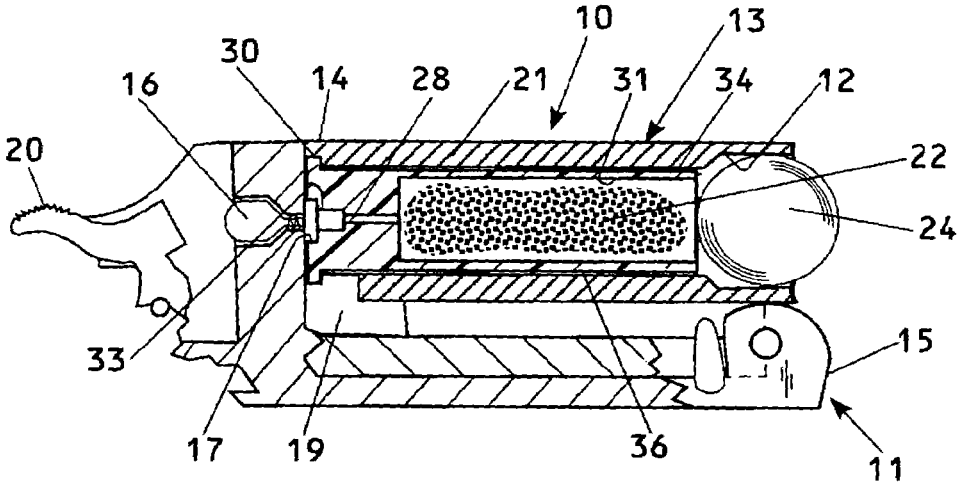
FIG. 3 is a side view, partially broken away and in cross section, of the plug of FIGS. 1 and 2, with the firearm loaded and in its closed position.
Figure 4:
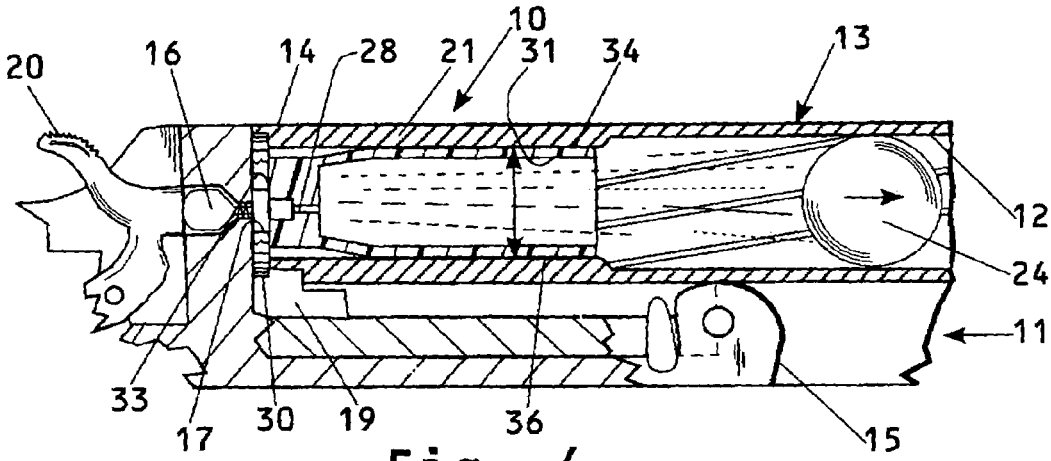
FIG. 4 is a view similar to the view of FIG. 3 immediately after the firearm is fired wherein the outer cylindrical walls of the plug have radially expanded or deformed to seal against the housing which accepts the plug.
Figure 5:
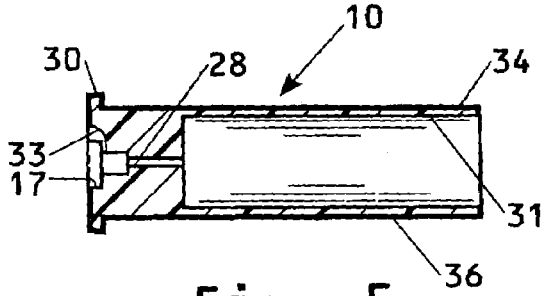
FIG. 5 is a side sectional view of one embodiment of the plug having a primer cup or chamber, a fire hole which communicates a primer spark, a powder chamber and a small notch adjacent the primer chamber which allows the primer to be removed from the plug.
Figure 6:
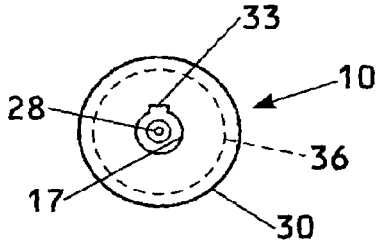
FIG. 6 is an end view of the plug of FIG. 5.

More specifically, referring to FIGS. 1-4, the plug 10 is to be slidably inserted into the housing 21 located at the breech end 14 of the axial-bore 12 of the barrel 13 of the rifle 11. A stock 15 supports the barrel 13. The rifle 11 also includes the firing pin 16 to discharge a cartridge primer or percussion cap received and retained within the primer chamber or holder 17 of the plug 10. A trigger 18 of the rifle 11 moves the firing pin 16 into engagement with the cartridge primer or percussion cap by means of a hammer 20. The rifle 11 typically includes an ejector mechanism 19 at a lateral peripheral rim portion 30 of the plug 10 to remove the plug 10 (i.e., FIG. 2) after firing as indicated in FIG. 4.

In each of the drawing figures, the shape of the breech plug primer chamber 17 represents the shape necessary for accepting 209 type shotgun primer. Other shapes required for accepting rifle-type primers or percussion caps are not shown, but are within the scope of this invention. Similarly, in each of these figures, the shape of the breech plug 10 is shown as cylindrical and containing the rim portion 30 to facilitate ejection of the plug 10, a small notch 33 for removal of the primer or percussion cap, and long thin walls 34 for containing part or all of the powder charge. These are preferred embodiments only and are not intended as limitations of the scope of this invention.

As shown in FIG. 3, the rifle 11 is loaded by inserting a charge of powder 22, wadding and shot 24 through the muzzle end of the barrel 13 and tamping the charge of powder 22 securely into the muzzle end 34 of the plug 10 and into a powder chamber 31 of the plug 10 using a loading rod. Depending on the size and amount of the charge of powder 22, some of the powder may extend outside of the powder chamber 31.

"Powder charge" is intended to represent any commercially available muzzle-loading propellant such as black powder, pyrodex, or smokeless powder and in any form such as loose powder or cake (pellet).

In the preferred embodiment, the non-threaded plug 10 is inserted into the housing 21 located at the breech end 14 of the barrel 13 as shown in FIG. 1. The plug 10 is capable of holding the percussion cap, a 209 (shotgun) type, or rifle type primer within the chamber 17. In the preferred embodiment, an essentially gas tight seal is achieved between a 209 type or rifle type primer and the plug 10 within the chamber 17.

In the preferred embodiment, the primer could be inserted into the breech plug 10 directly, without the use of tools or fixtures, and could be removed simply by prying it out of the chamber 17 with the blade of a pocketknife, etc. at the notch 33 adjacent the primer chamber 17.

The plug 10 includes a hole 28 that extends from the base of the primer chamber 17 to the powder chamber 31 of the breech plug 10 in order to communicate ignition from the primer to the powder charge 22.

In the preferred embodiment, the plug 10 has thin elongated walls 36 that extend into the housing 21 at the breech end 14 of the axial bore 12 so that part or all of the powder charge 22 can be held within the plug 10 thereby encouraging an essentially gas-tight seal of the plug walls 36 to the housing 21 during firing while at the same time containing much of the powder residue which is generated.

In the preferred embodiment, the plug 10 can be ejected after firing by the conventional ejector 19 of a "break-open" barrel design. This preferred design provides that essentially all of the powder residues are contained within the ejected breech plug 10 and the firearm's barrel 13. This design permits easy inspection and cleaning of the unobstructed barrel 13 without the need for awkward tools.

In the preferred embodiment, the removable breech plug 10 is made of inexpensive materials (such as a rifle or shotgun shell casing) so a used plug 10, though potentially reusable, can be disposed of directly, eliminating the need for cleaning it. Inherent to this design is the ability to unload the firearm 11 easily without firing by simply opening the gun 11 to eject the breech plug 10, removing the powder 22 by gravity from the breech, and driving the bullet/wad 24 from the barrel 13 using the loading rod.

Figure 7:
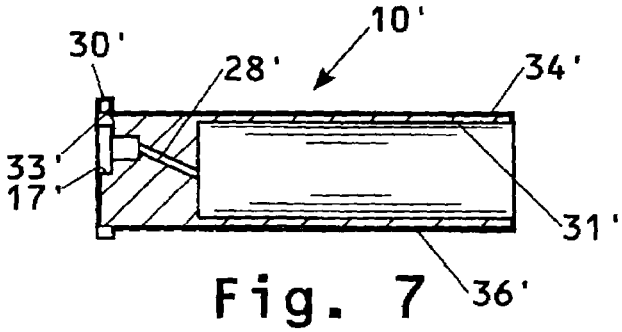
FIG. 7 is a side sectional view of another embodiment of the plug having its primer cup or chamber formed off-center.
Figure 8:
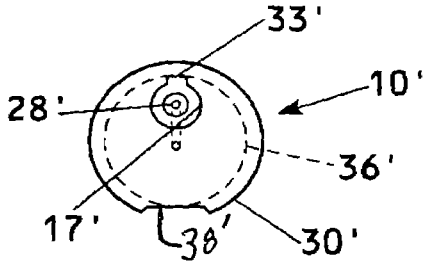
FIG. 8 is an end view of the plug of FIG. 7.

In another embodiment of a breech plug, generally indicated at 10' in FIGS. 7 and 8 (wherein the parts of the plug 10' having the same or similar structure and/or function as the plug 10 have the same reference number but a prime designation), the location of a primer holder or chamber 17' within the breech plug 10' is sufficiently "off center" (with respect to a central axis of the plug 10' ) to insure that the firearm 11 cannot be readily converted to fire conventional breech loading ("center fire") cartridges.

Figure 9:
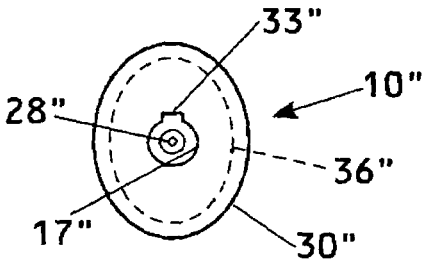
FIG. 9 is an end view of an oblong-shaped plug.
Figure 10:
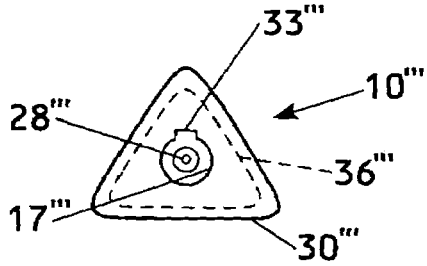
FIG. 10 is an end view of an essentially triangularly-shaped plug.

Other embodiments of a breech plug include a plug having an oblong cross-sectional shape (i.e., 10" in FIG. 9) and a plug having an essentially triangular cross-sectional shape (i.e., 10'" in FIG. 10). Parts of the plugs 10" and 10'" having the same or similar structure and/or function as the plugs 10 and 10' have the same reference number but a double prime or triple prime designation, respectively.

The breech plug 10' includes an alignment notch 38' which mates with a corresponding projection (not shown) at the breech end of the firearm barrel to ensure that the primer chamber 17' and its retained primer are consistently positioned at the same off-center location for striking by a firing pin of the firearm.

The plugs 10 and 10' are easy to remove, inexpensive to manufacture and the corresponding firearms are, simple to clean, and easy to unload without firing.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A muzzle-loading firearm comprising:

a barrel having a breech end and an axial bore;

a non-threaded receiver located at the breech end of the barrel wherein the receiver has a maximum cross-sectional inner dimension that is less than a diameter of the bore of the barrel; and a non-threaded breech plug in mating engagement with the receiver and including a body member having opposite first and second ends and an outer surface between the ends and configured so that the outer surface is spaced away from an inside surface of the receiver to facilitate insertion and removal of the plug and a passageway for fluidly communicating the first end with a powder charge at the second end when the firearm is loaded.

2. The firearm as claimed in claim 1, wherein the body member is formed with a powder chamber for receiving and retaining at least part of the powder charge at the second end when the firearm is loaded.

3. The firearm as claimed in claim 2, wherein the material and dimensions of the body member are such that the body member deforms radially outwardly so that the outer surface of the body member and the receiver form an essentially gas-tight seal during firing and the powder chamber contains much of the powder residue generated by the firing.

4. The firearm as claimed in claim 1, wherein the body member is formed with a chamber for receiving and retaining a primer or percussion cap at the first end and further comprising a notch adjacent the chamber to permit the primer or percussion cap to be removed from the chamber.

5. The firearm as claimed in claim 1, further comprising an ejector and a lateral peripheral rim portion at the first end of the breech plug to allow the plug to be ejected from the firearm by the ejector.

6. The firearm as claimed in claim 1, wherein the body member is formed with a chamber for receiving and retaining a primer or percussion cap at the first end and further comprising an alignment wherein a firing pin and the chamber of the breech plug are disposed along a central axis of the plug.

* * * * *